US005983654A

United States Patent [19]

Yamamoto et al.

[11] Patent Number: 5,983,654

[45] Date of Patent: Nov. 16, 1999

[54] FREEZER-EQUIPPED REFRIGERATOR

[75] Inventors: Kazu Yamamoto; Toshie Hiraoka; Mutsumi Kato; Katsumasa Sakamoto; Kunihiko Yagi, all of Tokyo, Japan

[73] Assignee: Mitsubishi Denki Kabushiki Kaisha, Tokyo, Japan

[21] Appl. No.: 08/861,804

[22] Filed: May 22, 1997

[30] Foreign Application Priority Data

Aug. 8, 1996 [JP] Japan ..... 8-209648

[51] Int. Cl.[6] ..... F25D 17/08

[52] U.S. Cl. ..... 62/187; 236/49.3

[58] Field of Search ..... 62/187; 236/49.3

[56] References Cited

U.S. PATENT DOCUMENTS

| | | | |
|---|---|---|---|
| 3,048,024 | 8/1962 | Jacobs | 62/156 |
| 3,070,973 | 1/1963 | O'Connell | 62/187 |
| 3,233,422 | 2/1966 | Kobrin | 62/155 |
| 3,411,312 | 11/1968 | Sigl et al. | 62/180 |
| 3,455,119 | 7/1969 | Bright | 62/180 |
| 3,590,594 | 7/1971 | Arend | 62/187 |
| 4,009,589 | 3/1977 | Webb et al. | 62/187 |
| 4,921,164 | 5/1990 | Gotou et al. | 236/49.3 |
| 5,004,149 | 4/1991 | Narikiyo et al. | 236/49.3 |
| 5,025,638 | 6/1991 | Yamagishi et al. | 62/180 |
| 5,076,346 | 12/1991 | Otsuka | 236/49.3 |
| 5,209,073 | 5/1993 | Thomas et al. | 62/81 |
| 5,359,860 | 11/1994 | Oh | 62/97 |

FOREIGN PATENT DOCUMENTS

| | | | |
|---|---|---|---|
| 5-93571 | 4/1993 | Japan | 62/187 |
| 7-11379 | 2/1995 | Japan . | |

*Primary Examiner*—William E. Tapolcai
*Attorney, Agent, or Firm*—Oblon, Spivak, McClelland, Maier & Neustadt, P.C.

[57] ABSTRACT

In a freezer-equipped refrigerator, a refrigerating chamber or freezing chamber is divided into a plurality of sections having substantially same temperature zone. A temperature element is provided in each section, and an open/close damper and a duct for supplying cool wind for each section are also provided. In such a structure, control is made on whether or not cool wind should be supplied or not in accordance with a detected temperature.

13 Claims, 14 Drawing Sheets

FIG. 6

| FIRST ELEMENT | SECOND ELEMENT | \| (FIRST ELEMENT) - (SECOND ELEMENT) \| | DAMPER 20A | DAMPER 20B |
|---|---|---|---|---|
| H | H | h | OPEN | OPEN |
| H | H | ℓ | OPEN | CLOSE |
| H | L | h | CLOSE | OPEN |
| H | L | ℓ | CLOSE | OPEN |
| L | H | ℓ | OPEN | CLOSE |
| L | L | h | CLOSE | CLOSE |
| L | L | ℓ | CLOSE | CLOSE |

ABSOLUTE VALUE IS HIGHER THAN SETTING VALUE: "h"

ABSOLUTE VALUE IS LOWER THAN SETTING VALUE: "ℓ"

HIGHER THAN SETTING VALUE: "H"

LOWER THAN SETTING VALUE: "L"

| FIRST ELEMENT | SECOND ELEMENT | DAMPER STATIONARY POINT |
|---|---|---|
| H | H | FULL OPEN |
| H | L | HALF OPEN |
| L | H | FULL OPEN |
| L | L | CLOSE |

FIG. 10

| FIRST ELEMENT | SECOND ELEMENT | \| (FIRST ELEMENT) - (SECOND ELEMENT) \| | DAMPER 41 | DAMPER 40 |
|---|---|---|---|---|
| H | H | h | OPEN | UPPER STAGE |
| H | H | ℓ | OPEN | BOTH STAGE |
| H | L | h | OPEN | UPPER STAGE |
| H | L | ℓ | OPEN | UPPER STAGE |
| L | H | ℓ | OPEN | LOWER STAGE |
| L | L | h | CLOSE | UPPER OR LOWER STAGE |
| L | L | ℓ | CLOSE | |

ABSOLUTE VALUE IS HIGHER THAN SETTING VALUE: "h"

ABSOLUTE VALUE IS LOWER THAN SETTING VALUE: "ℓ"

HIGHER THAN SETTING VALUE: "H"

LOWER THAN SETTING VALUE: "L"

FREEZER-EQUIPPED REFRIGERATOR

BACKGROUND OF THE INVENTION

1. Field of the Invention

The present invention relates to a cool air supply in a freezer-equipped refrigerator.

2. Description of the Related Art

FIGS. 13 to 16 show conventional cool air wind passage structures. FIG. 13 is an appearance view of a conventional freezer-equipped refrigerator. FIG. 14 is a transparent perspective view showing a cool air wind structure of the conventional freezer-equipped refrigerator. As seen from FIG. 13, a freezer-equipped refrigerator 1 includes a refrigerating chamber 2 and freezing chambers 3 located below the refrigerating chamber 2. As shown in FIG. 14, the freezing chamber 3 incorporates a heat exchanger 4 and a fan 5 for circulating cool air located above the fan 5. The cool wind blown off from the fan 5 is branched into several areas. It blows off into the refrigerating chamber 2 as follows. It is taken in from an inlet 6, passes a duct 8 via an opening/closing damper 7 and blows off toward respective shelves from cool air blow-off openings 9. The blown off cool wind cools food or others in the refrigerating chamber 2 and drawn into an inhalation inlet 10. The cool wind further passes a return wind passage 11 to return to the lower part of the heat exchanger 4. Then, the cool wind is cooled again by the heat exchanger 4 and sent to the refrigerating chamber 2 and the like, and such circulation is repeated. Reference numeral 12 represents an element for detecting the temperature within the refrigerating chamber. FIG. 15 shows a control substrate 80 for controlling whether or not the circulation of cool wind should be carried out. FIG. 16 is a flowchart of a control of the circulation of cool wind. When the element 12 detects that the temperature of the refrigerating chamber 2 is higher than a setting value, the fan 5 rotates and the damper 7 opens so that cool wind is supplied to the respective shelves of the refrigerating chamber 2. Incidentally, in this case, it is assumed that a compressor for supplying refrigerant to the heat exchanger is rotating. When the temperature of the refrigerating chamber 2 detected by the element 12 is lower than the setting value, the damper 7 is closed. The fan 5, in accordance with the temperature of other chambers, continues to rotate or stops. By the repetition of such an operation, the temperature of the refrigerating chamber 2 is controlled so as to be constant.

One example of the conventional technique is disclosed in Japanese Patent Examined Application Hei. 7-11379.

Owing to the structure and control described above, the conventional freezer-equipped refrigerator has the following problems. If the chamber in a uniform temperature zone are sectioned by plural shelves or boxes, the temperature difference between the temperature of the element 12 and the sectioned places is increased. Accordingly, it is difficult to maintain the temperature of the refrigerating chamber at a predetermined temperature. Additionally, when the door of the refrigerating chamber 2 is opened, the temperature of the refrigerating chamber 2 increases. However, the temperature does not increase uniformly, and the temperature of an upper zone is increased. If the setting value is lowered in order to suppress such a phenomenon, inversely the temperature of the lowest section becomes lower than the setting value.

SUMMARY OF THE INVENTION

It is an object of the present invention to provide a freezer-equipped refrigerator with no variation in the temperature in a refrigerating chamber or a freezing chamber and good cooling performance.

A freezer-equipped refrigerator according to the present invention comprises: a refrigerating chamber; a freezing chamber; a plurality of sections formed within at least one of the refrigerating chamber and the freezing chamber, a setting temperature of the sections being substantially equal; temperature detecting means provided in each of the sections, for detecting a temperature of each section; a plurality of cool air supply ducts each having at least one cool air blow-off opening for supplying the cool air to each of the sections, the number of the cool air supply ducts being equal to the number of the temperature detecting means or the sections; opening/closing means for opening/closing an inlet for sucking the cool air into the cool air supply duct; and control means for controlling the open/close of the opening/closing means.

According to the present invention, the temperature of a plurality of sections formed in the refrigerating chamber or a freezing chamber can be uniform.

BRIEF DESCRIPTION OF THE DRAWINGS

In the accompanying drawings:

FIG. 6 is a table showing the relationship between each of the detected values of elements of a freezer-equipped refrigerator and open/close of each damper;

FIG. 10 is a view showing the relationship between the detected values and the standing point of a wind adjusting damper in a freezer-equipped refrigerator according to the third embodiment;

PREFERRED EMBODIMENTS OF THE INVENTION

Preferred embodiments of the present invention will be described as follows referring to the accompanying drawings.

Embodiment 1

Figure 1:
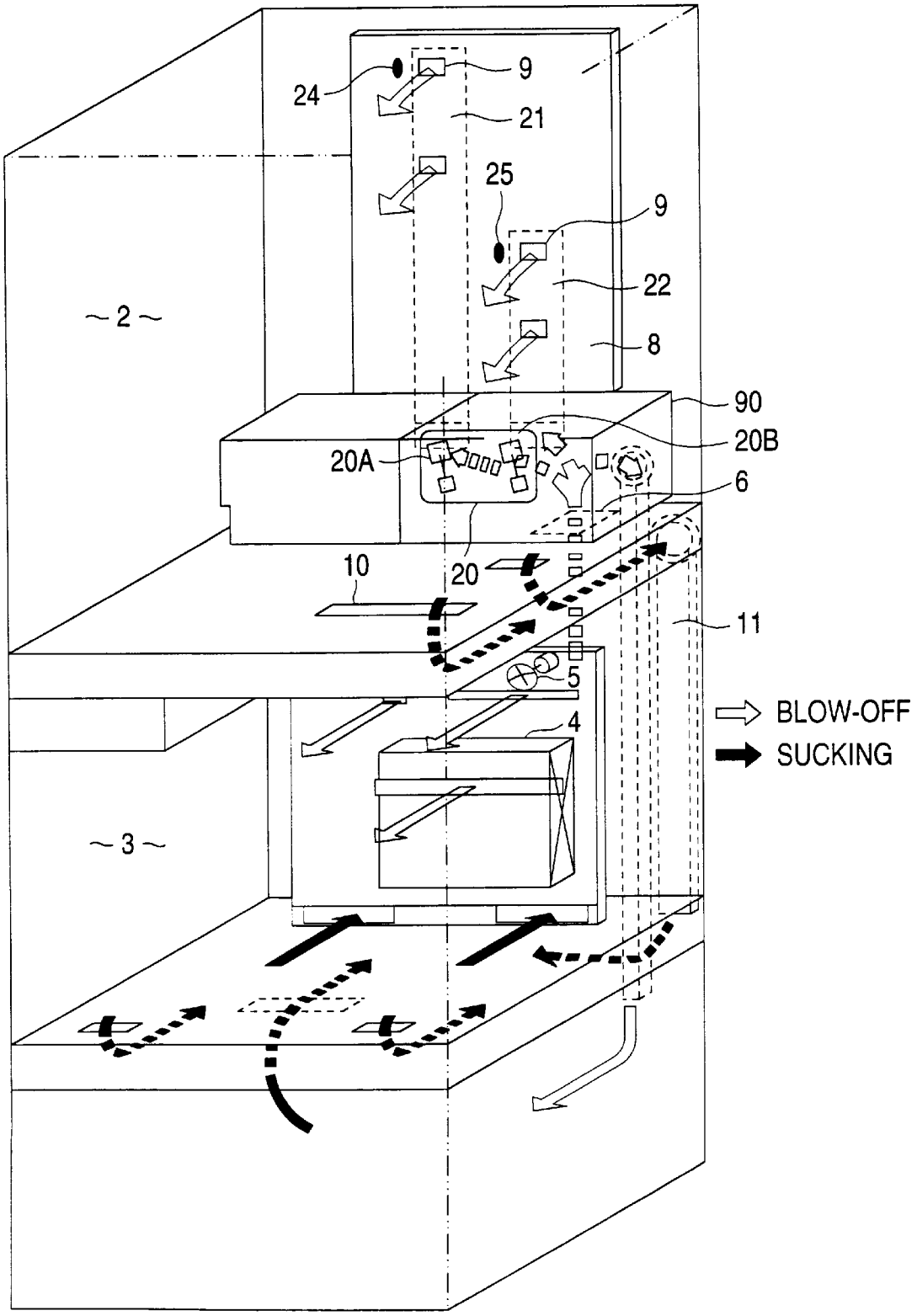
FIG. 1 is a general view of a freezer-equipped refrigerator.
Figure 2:
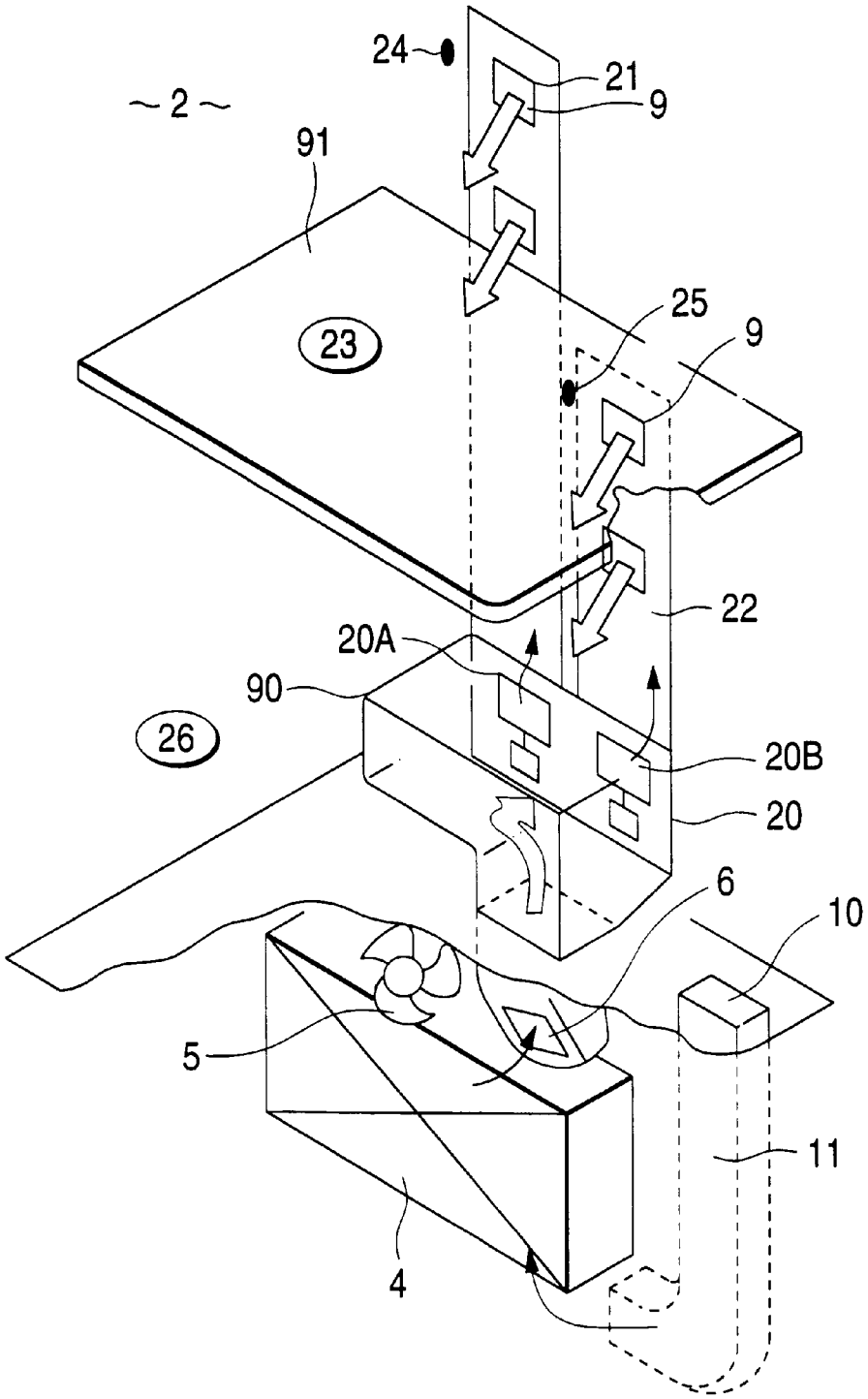
FIG. 2 is a perspective view showing the cool wind circulating wind passage of a freezer-equipped refrigerator according to the first embodiment according to the present invention.

FIG. 1 is a perspective view showing a cool wind circulating passage of a freezer-equipped refrigerator according to the embodiment of the present invention. FIG. 2 is an enlarged view of the main part in FIG. 1. In FIG. 1, the freezer-equipped refrigerator 1 includes a refrigerating chamber 2 including two sections 23 and 26 (see, FIG. 2) having setting temperature of 0–10° and a freezing chamber 3 located below the refrigerating chamber 2. As shown in FIG. 2, the refrigerating chamber 2 is divided into the sections 23 and 26 by a partition plate 91. This partition plate may be a plate-like plate, a net-like plate or the like. However, it is possible to omit the partition plate 91 in this embodiment. As shown in FIG. 1, the freezing chamber 3 incorporates a heat exchanger 4 and a fan 5 for circulating cool air located above the heat exchanger 4. The cool wind blown off from the fan 5 is branched into several areas. It blows off into the refrigerating chamber 2 as follows. It is taken in from inlet 6, passes a box 90 in which a wind passage may be provided to communicate with each damper of a twin damper 20 or a base plate may be installed, and reaches a twin damper 20 which is a damper portion having a plurality of dampers. An UP damper 20A which is one of the plural opening/closing inlets serves to open/close an upper section duct 21 whereas an LR damper 20B which is also one of the plural closing opening/closing inlets serves to open/close a lower section duct 22. An upper section 23 is provided with a first temperature detecting element 24 which is one of temperature detecting elements whereas a lower section 26 is provided with a second temperature detecting element 25 which is also one of the temperature detecting elements. The upper section duct 21 and lower section duct 22 are provided with cool air blow-off openings 9 at the intermediate position and distal positions of tubes, which blow off the cool wind. The blown-off cool wind cools the food and others within the refrigerating chamber 2 and is drawn into an inhalation opening 10. The cool wind further passes a return wind passage 11 to return to the lower part of the heat exchanger 4. Then, the cool wind is rid of heat again by the heat exchanger 4 and sent to the refrigerating chamber 2 and others. Such circulation is repeated.

As shown in FIG. 2, in this embodiment, the refrigerating chamber 2 is divided to an upper section 23 and a lower section 26 by a separating plate 91. However, the refrigerating chamber 2 may be divided into three or more sections. The separating plate may be a plate-shaped plate, a net-shaped plate or the like. Furthermore, for example, one of the sections may be a closed type box.

Figure 3:
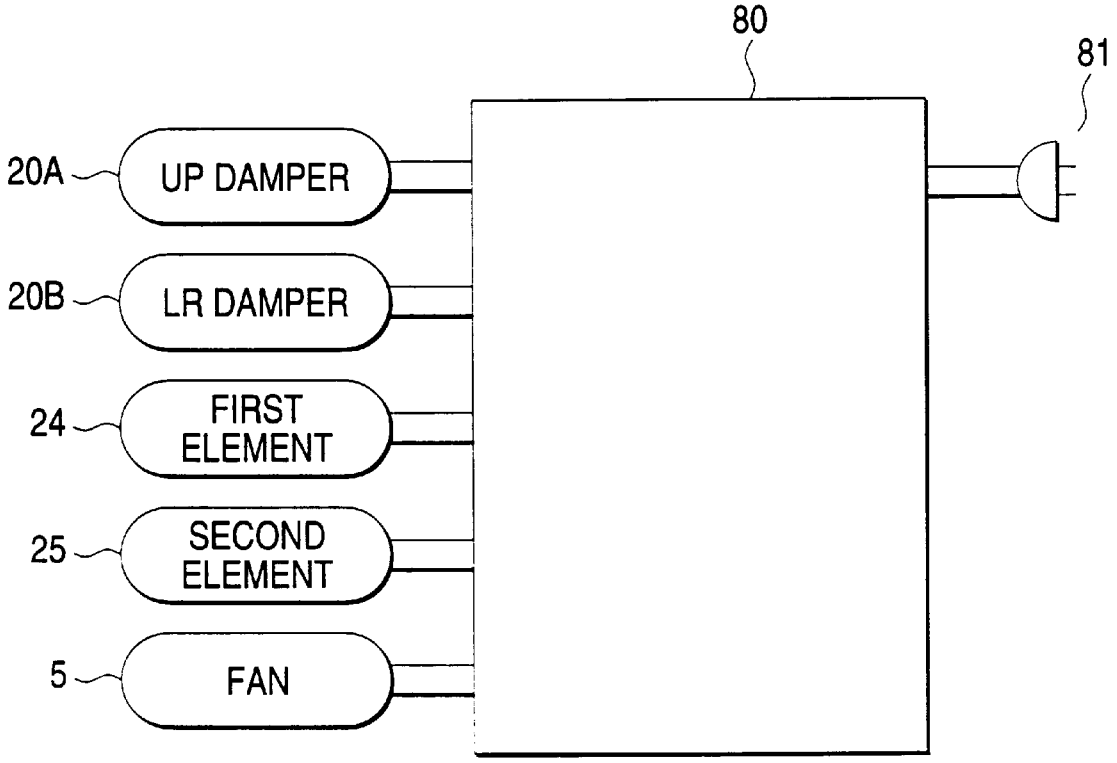
FIG. 3 is a schematic view of a control substrate for controlling whether the circulation of cool wind should be effected in a freezer-equipped refrigerator according to the first embodiment.
Figure 4:
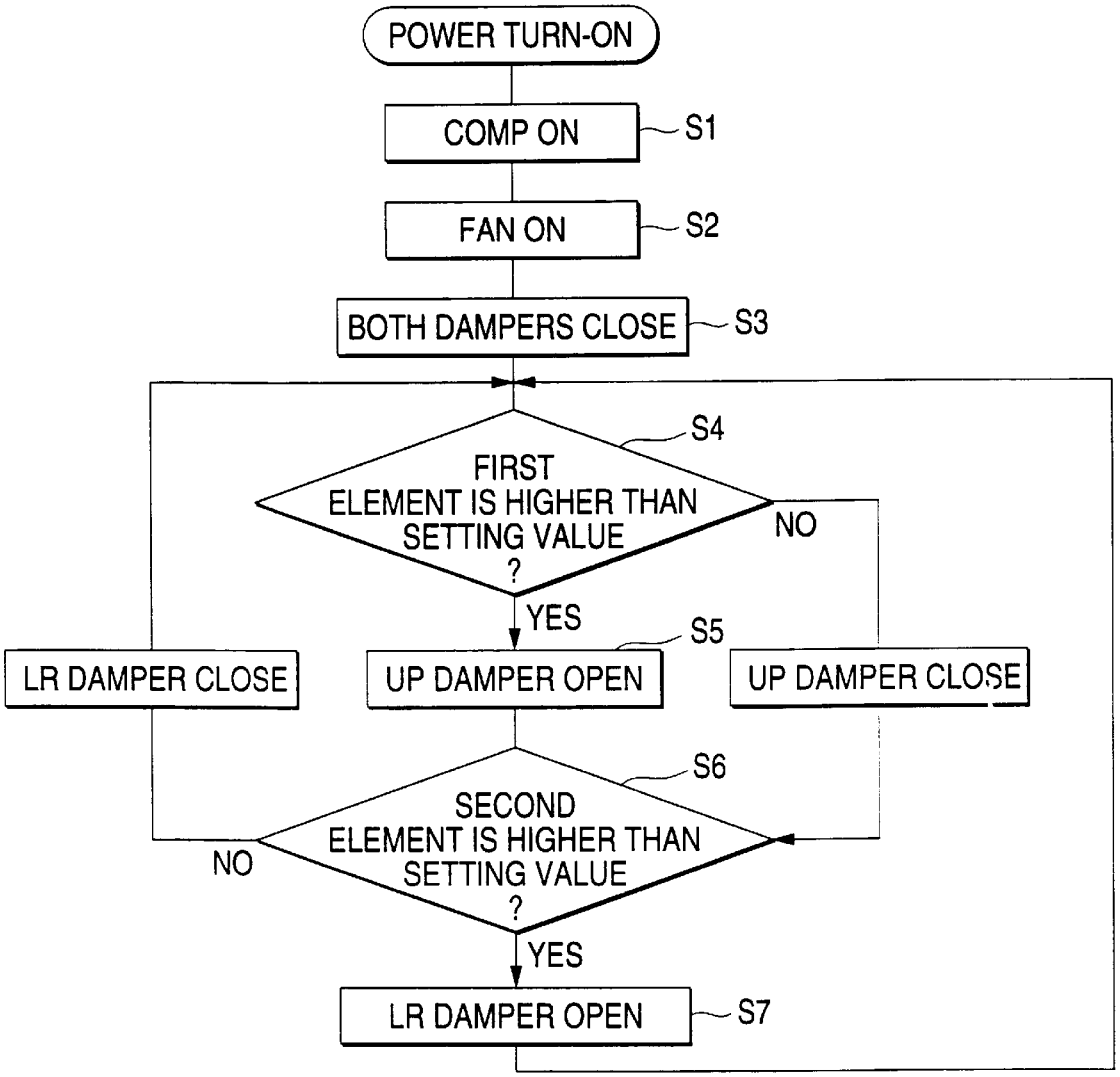
FIG. 4 is a control flowchart for controlling whether the circulation of cool wind should be effected in a freezer-equipped refrigerator according to the first embodiment.

The temperature control within the refrigerating chamber will be explained. FIG. 3 is a schematic view of a control substrate 80 for controlling whether or not the above cool wind circulation should be carried out. FIG. 4 is a flowchart of the controlling operation. In FIG. 4, when a power source is turned on, a compressor turns ON (S1), a fan turns ON (S2), and an UP damper and LR damper close (S3). If the temperatures detected by the respective first and second temperature detecting elements 24, 25 are higher than setting values, respectively (S4, S6), the fan 5 rotates and the opening/closing dampers (UP damper 20A and LR damper 20B) open (S5, S7) to lower the temperatures to the setting values. When the temperatures at the respective elements become lower than the setting values, respectively, the corresponding opening/closing dampers close.

As described above, in the freezer-equipped refrigerator according this embodiment, since a temperature detecting element is arranged within each of the sections having substantially equal setting temperatures, and the cool wind blown off from each of the ducts dedicated to the individual sections is locally controlled in accordance with the detected temperature. For this reason, the temperatures with the respective sections can be made uniform with high accuracy so that the freshness of food can be maintained for a long time. Even if "high burden" food at high temperatures are put locally or only within a certain section, the remaining sections are prevented from being cooled excessively so that the food therein can be cooled to prescribed temperatures. Further, since there is provided the twin damper which is a damper portion having a plurality of dampers, even if either damper suffers a breakdown, complete impossibility of cooling does not occur. In this embodiment, although an upper section and lower section are used as individual sections, they may be further divided in some sections.

Embodiment 2

Figure 5:
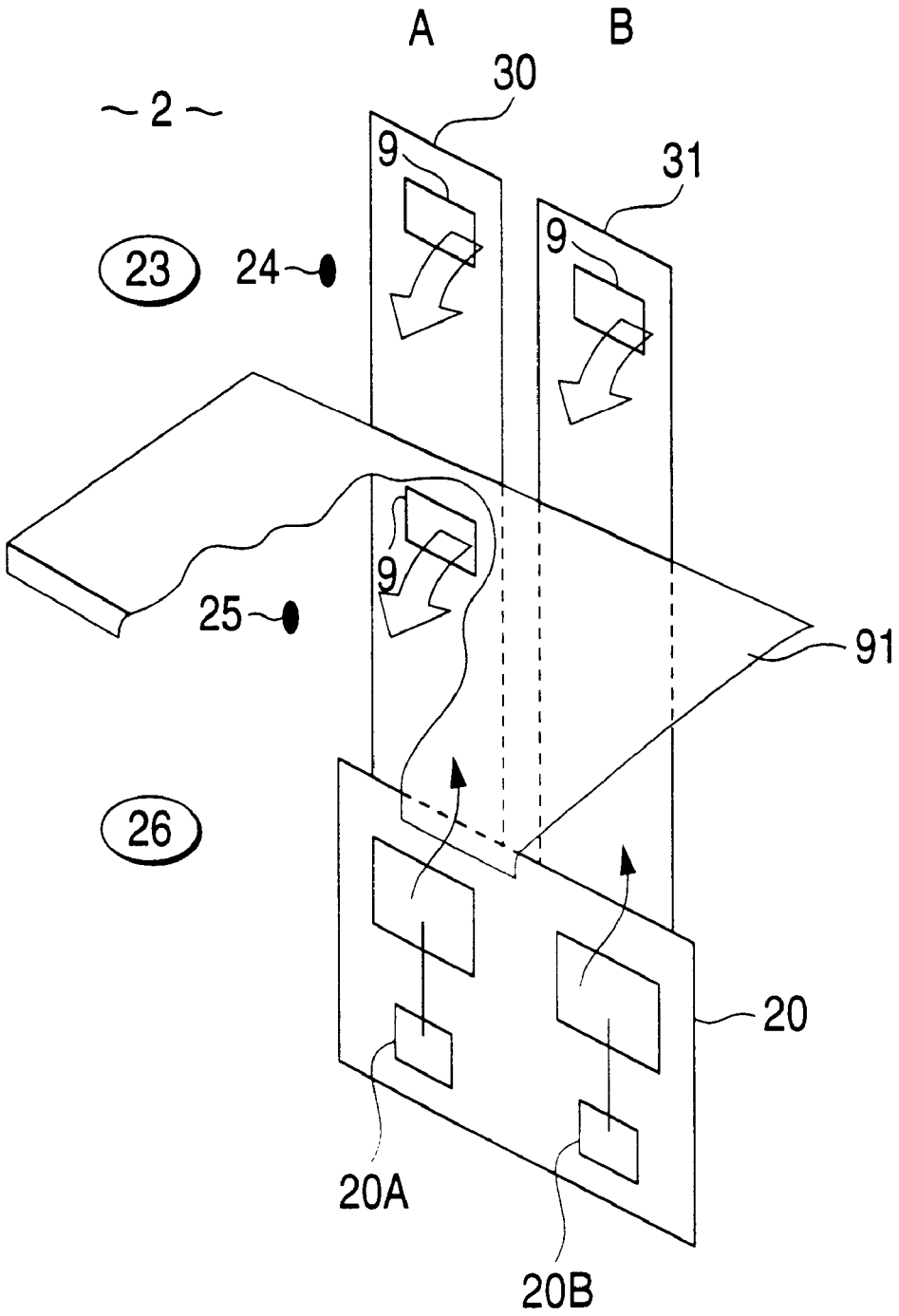
FIG. 5 is a perspective view showing the cool wind circulating wind passage of a freezer-equipped refrigerator according to the first embodiment according to the present invention.

The second embodiment is different from the first embodiment in the structure of ducts succeeding to the opening/closing dampers and the controlling method. FIG. 5 is a perspective view showing the cool wind circulating wind passage of the freezer-equipped refrigerator according to the second embodiment. A first duct 30 communicating with the one damper 20A of the twin damper 20 has cool wind blow-off openings 9 provided at the lower section 26 and upper section 23. On the other hand, a second duct 31 communicating with the other damper 20B of the twin damper 20 has the cool wind blow-off opening 9 provided at only the upper section 23. The first temperature detecting element 24 is arranged in the upper section whereas the second temperature detecting element 25 is arranged in the lower section 25. The coupling manner of the above elements with the control substrate 80 is the same as in the first embodiment.

An explanation will be given of the operation of the freezer-equipped refrigerator according to the second embodiment. FIG. 6 is a table showing the relationship between the temperatures at the temperature detecting elements and the open/close in each of the dampers of the twin damper 20. For example, if the temperature at the first element 25 is higher than a setting value ("H" in the table), that at the second element 25 is higher than a setting value ("H" in the table) and the absolute value the difference between the values detected by the first elements 24 and 25 is larger than a prescribed value ("h" in the table), both dampers of the twin damper 20 open to supply the cool wind. On the several conditions, if the absolute value of the difference between the values read by the elements is smaller than the prescribed value ("l" in the table), only the damper 20A opens. The operation described above applies to the case where the temperature of the upper section 23 is higher than that of the lower section 26. On the other hand, if the temperature of the lower section 26 is higher than that of the upper section 23, the cool wind blow-off opening 9 of the second duct 31 is arranged on the lower section 26 so that the relationship of the open/close of the dampers as shown in FIG. 6 can be applied. In this case, when either damper opens, the fan 5 rotates, and when both dampers close, the fan 5 is controlled in accordance with the temperature in the other sections.

As described above, in accordance with this embodiment, in a normal state, the upper section 23 and lower section 26 are cooled by the damper 20A, and only under a certain condition (the temperature at the first element 24 is higher than that at the second element 25 by a prescribed value or more), the damper 20B opens. For this reason, the temperature difference between the upper section 23 and the lower section 26 can be minimized. In addition, even if either damper suffers a breakdown, complete impossibility of cooling does not occur. Namely, the cooling by only the damper 20B permits the lower section to be convection-cooled slightly. In this embodiment, although an upper section and lower section are used as individual sections, they may be further divided in sections.

[0018]

Embodiment 3

Figures 7, 8:
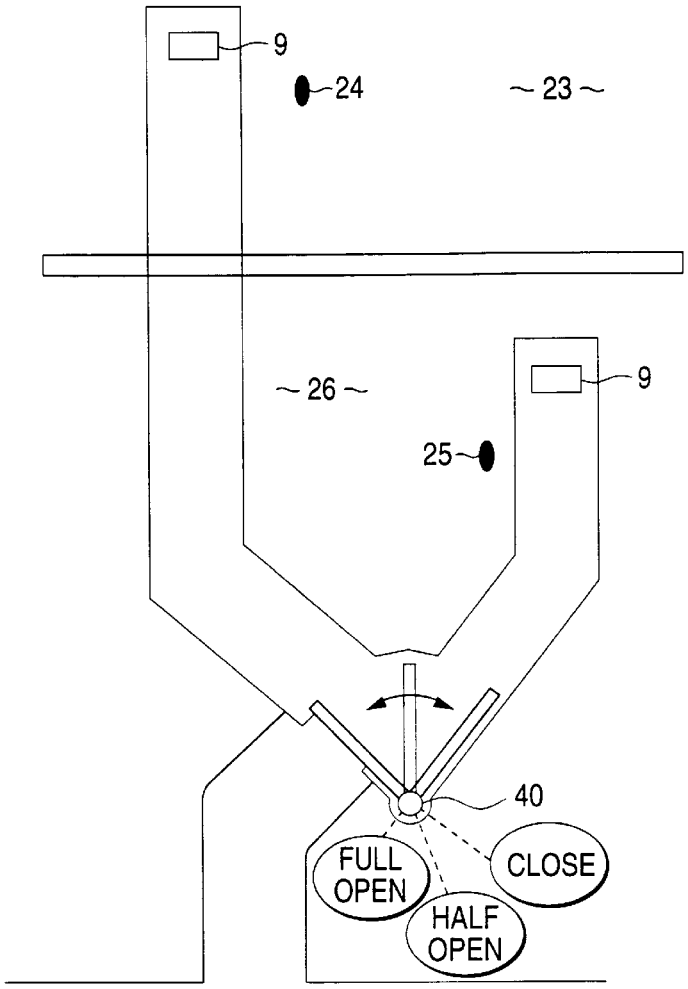
FIG. 7 is a schematic view of a control substrate for controlling whether the circulation of cool wind should be effected in a freezer-equipped refrigerator according to the third embodiment.
FIG. 8 is a view showing the relationship between the detected values and the standing point of a wind adjusting damper in a freezer-equipped refrigerator according to the third embodiment.

Third embodiment according to the present invention is different from the second embodiment in the duct structure incorporating an opening/closing damper and the control method. FIG. 7 is a perspective view showing the cool wind circulating passage of the freezer-equipped refrigerator according to the third embodiment. In FIG. 7, reference numeral 40 represents a wind orientation adjusting damper which can adjust the opening/closing angle over 180° with high accuracy (using a two-phase exciting stepping motor as a driving source). The wind orientation adjusting damper has damper stationary points whose number is equal to the number of cool wind supply ducts communicating with the cool wind blow-off openings 9 which supply cool wind to the respective sections in the refrigerator 40 plus one point of wind passage closure. For example, where at the tip of the wind orientation damper, two ducts are located which communicate with the cool wind blow-off opening at the upper section 23 and lower section 26 , there are three stationary points. At the upper section 23, the first temperature detecting element 24 is provided in the upper section 23 whereas the second temperature detecting element 25 is provided in the lower section 26. The coupling manner of the above elements with the control substrate 80 is the same as in the second embodiment.

The operation of the freezer-equipped refrigerator according to the third embodiment will be explained.

FIG. 8 is a table showing the relationship between the temperatures at the temperature detecting elements and the stationary point of the wind adjusting damper 40. For example, if the temperature at the first element 24 is higher than a setting value ("H" in the table), that at the second element 25 is higher than a setting value ("H" in the table), the stationary point is fully open. If only the temperature at the first element 24 is higher than the setting temperature, the stationary point is half open. If both the temperatures at the first and second elements 24 and 25 are lower than the setting values, the stationary point is close.

For the reason described above, in the freezer-equipped refrigerator according to this embodiment, the temperature difference between the upper section 23 and the lower section 26 can be minimized and this can also be minimized using a single component (wind orientation damper 40). This reduces the production cost of the refrigerator. In this embodiment, although an upper section and lower section are used as individual sections, they may be further divided into several sections. Additionally, in FIG. 7, two ducts are located individually for the upper section 23 and lower section 26. But if ducts are located for the upper section 23 and for both upper and lower sections, the wind orientation damper 40 is opened or closed on the basis of the same manner as in the second embodiment, i.e., the differences between the detected temperatures of the temperature detecting elements 24 and 25 from their setting values, and the absolute value between the detected values of the respective elements.

Figure 9:
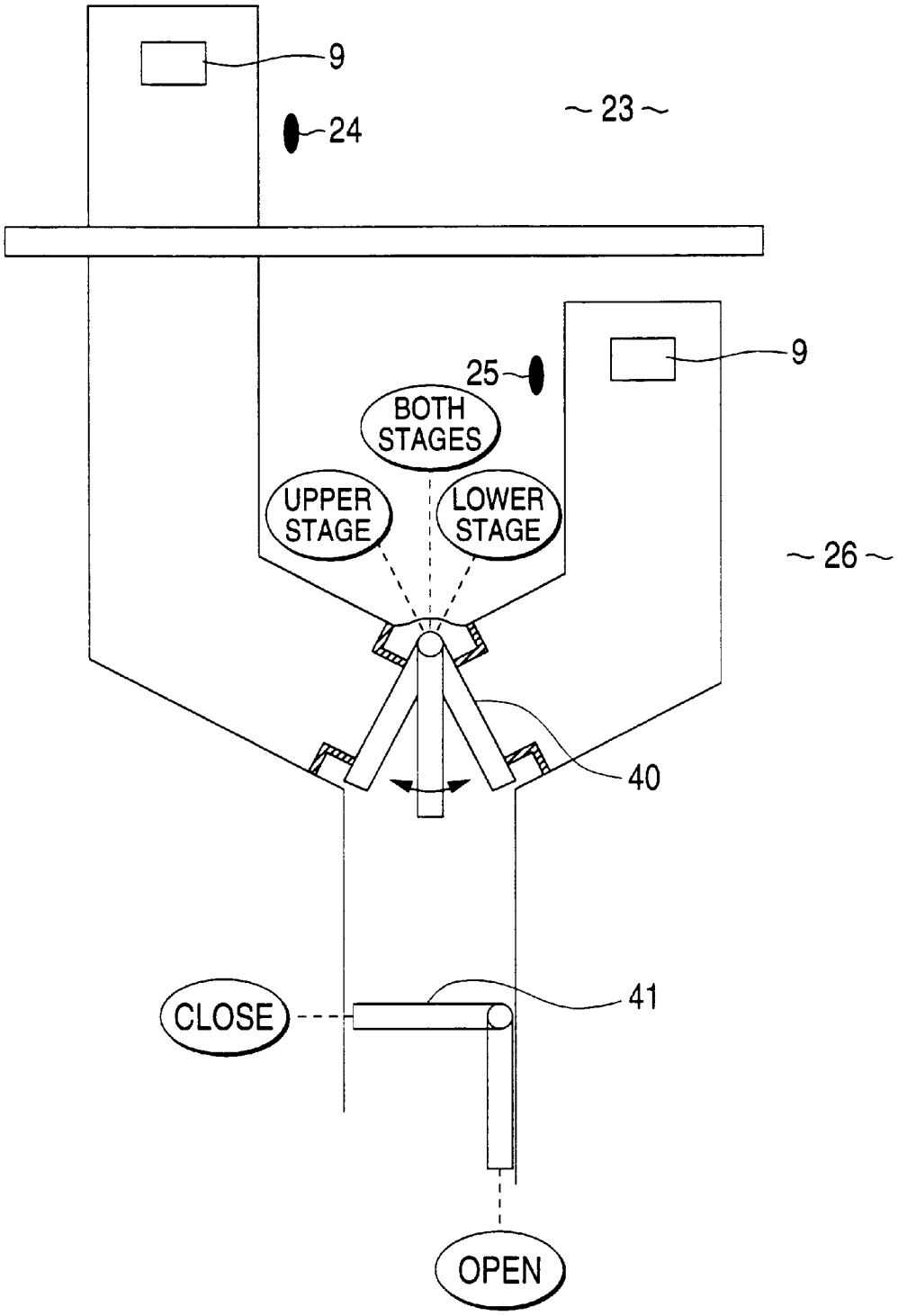
FIG. 9 is a perspective view showing the cool wind circulating passage in a freezer-equipped refrigerator according to the third embodiment.

FIG. 9 shows a duct structure which can also supply cool wind to only the duct communicating with the cool wind blow-off opening in the lower section 26. In this structure, the first and second temperature detecting elements 24 and 25, the damper 41 and the wind orientation damper 40 are used so that the full or half opening of the damper 41 and the opening or closing of the wind orientation adjusting damper 40 are controlled on the basis of the temperatures detected by the temperature detecting elements at the upper and lower sections of the freezing chamber. If both the temperatures detected by the elements 24 and 25 are higher than the setting values, the damper 41 is opened and the wind orientation damper 40 is located at both sections in FIG. 9 to supply cool wind to both ducts. If only the temperature detected by the one element is higher than the setting value, the damper 41 is opened and the wind orientation adjudging damper 40 is placed in one-side opened. Such a control intends to make the temperature uniform. FIG. 10 is a table showing a method of controlling the wind orientation adjusting damper 40 and the damper 41. For example, if the temperature at the element 25 is higher than a setting value ("H" in the table), that at the element 25 is higher than a setting value ("H" in the table) and the absolute value of the difference between the values detected by the elements 24 and 25 is larger than a prescribed value ("h" in the table), the damper 41 is open and the wind orientation adjusting damper 40 is located at an upper section position to supply cool wind to the upper section. Either upper section or lower section is determined by positioning of the origin of the damper 40.

Embodiment 4

Figure 11B:
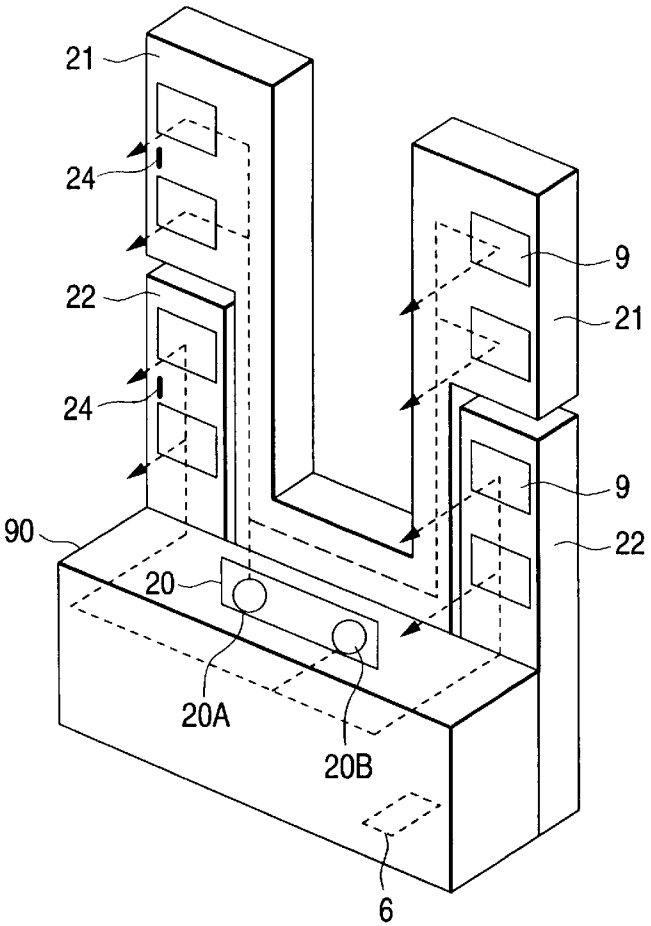
FIGS. 11A and 11B are perspective views showing the cool wind circulating passage in a freezer-equipped refrigerator according to the fourth embodiment.
Figure 11A:
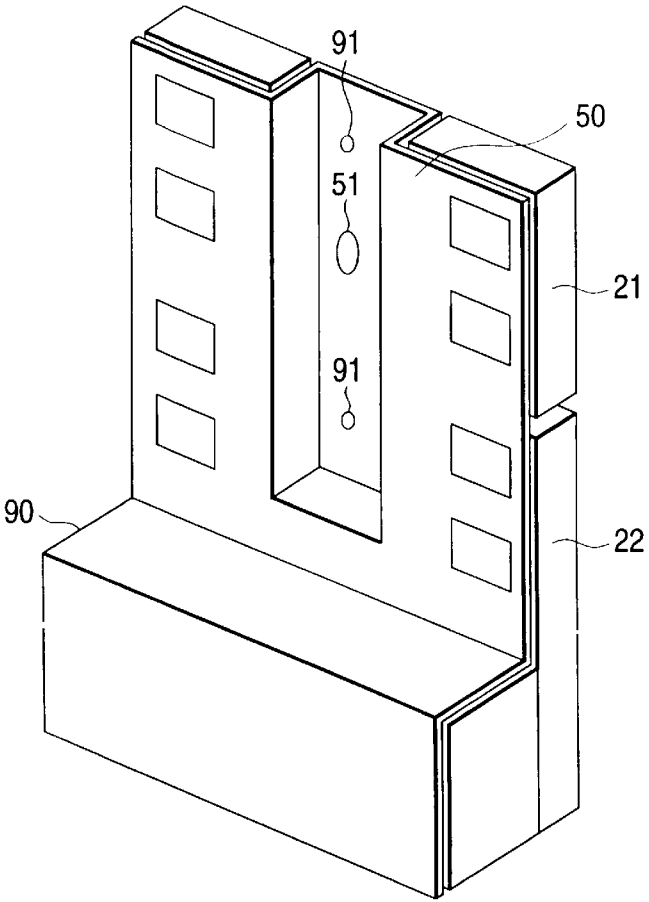

The forth embodiment is different from the first embodiment in a duct structure. FIG. 11A is a perspective view of a freezer-equipped refrigerator according to the fourth embodiment. As shown in FIG. 11A, a refrigerator inside lamp 51 is fixed at the center of a partition plate 50 between an internal plate and the inside of the background of the refrigerator 2. The partition plate 50 is fixed to the internal plate of the refrigerator 2 by a screw 91. An upper duct 21 and a lower duct 22 are fixed between the partition plate and the internal plate. FIG. 11B is a perspective view of the cool wind circulating wind passage in which the partition plate 50 at the back of the freezing chamber 2 is removed for convenience of explanation. Since the cool wind supply ducts 21 and 22 are arranged on both sides on the back of the refrigerator, the refrigerator lamp 51 can be installed on the center of the back of the refrigerator 51. The cool air taken in from the cool air of a box 90 passes through the twin damper 20 and blows off to the cool air blow-off opening 9 of each duct. One of the wind passages of the ducts 20 and 22 is the front in the box 90 whereas the other thereof is the rear (back) in the box 90. For example, if the cool air supply ducts (upper section duct) 21 and the cool air supply ducts (lower section duct) 22 are provided on both sides of the back of the refrigerator, the lower ducts 22 separately blows up the cool air from the damper 20B towards both sides through this side (forward of the box 90) whereas the upper ducts 21 directly blows up the cool air toward both sides directly from the damper 20A. Inversely, the lower ducts 22 may blow up the cool air from the damper 20B towards both sides directly from the damper 20B whereas the upper ducts 21 may separately blow up the cool air toward both sides through this side (forward of the box 90) from the rear of the box 90. Because of such an arrangement of these wind passages, they do not overlap one another, and the ducts are not located on only the front side. Thus, the section within the refrigerator can be effectively used. Further, the cool wind can be supplied to the ducts each located on the upper and lower sections on both sides of the refrigerator lamp. The coupling manner of the above elements with the control substrate 80 and its operation are the same as in the second embodiment. Provision of the upper and lower ducts 21 and 22 on both sides further improves the accuracy of making uniform the temperatures at the respective points obtained in the first embodiment. The limitation to the width of the refrigerator lamp due to the increase in the number of ducts and wind passages can be reduced, thereby improving the design.

In FIG. 11B, a recess may be provided at the area on the center side of the refrigerator of the upper duct 21 where the cool wind blow-off opening 9 is not extended. This increases the illumination range of the lamp by the degree corresponding to the recess.

Embodiment 5

Figure 12:
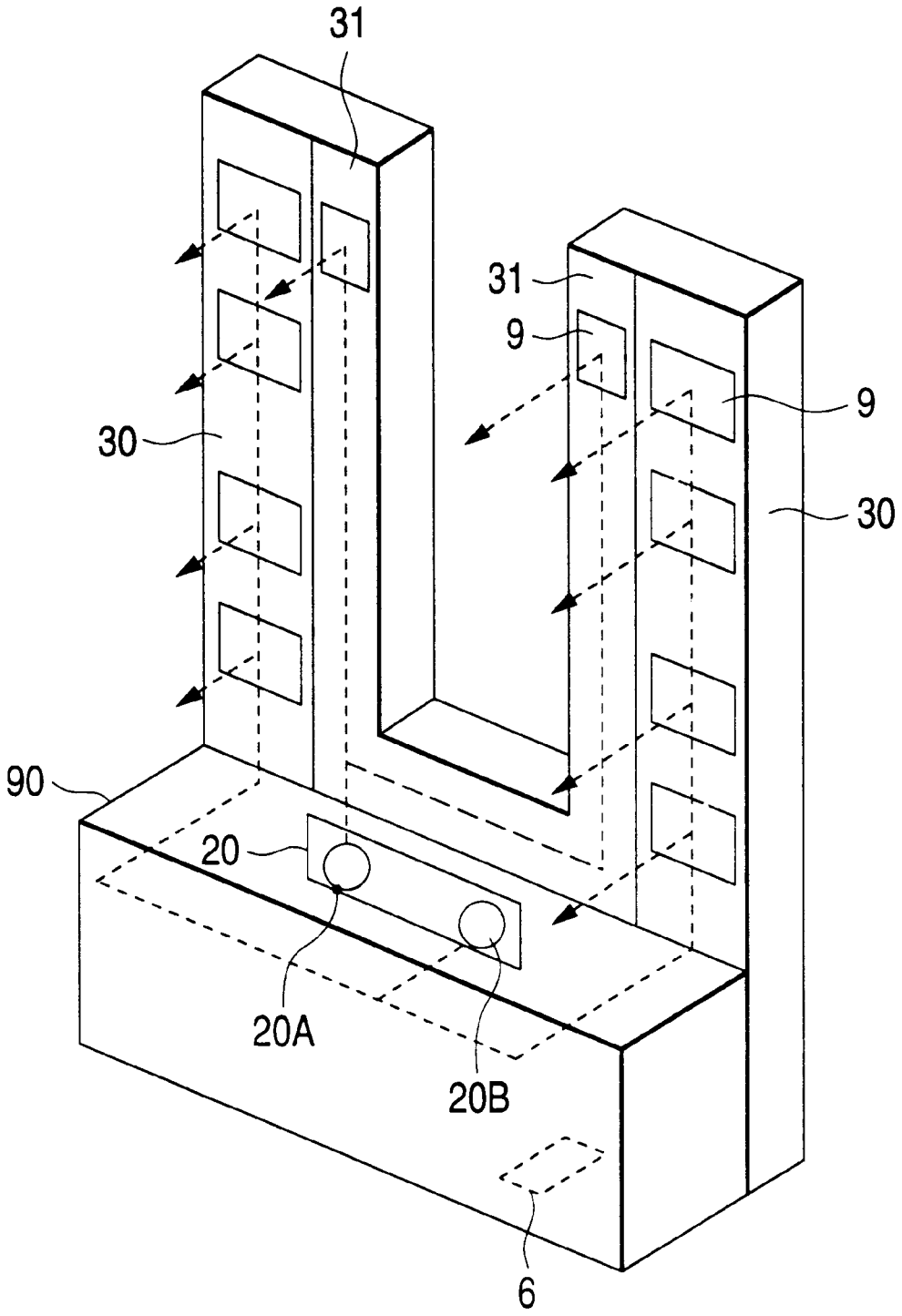
FIG. 12 is a perspective view showing the control wind circulating passage in a freezer-equipped refrigerator according to the fifth embodiment.
Figure 13:
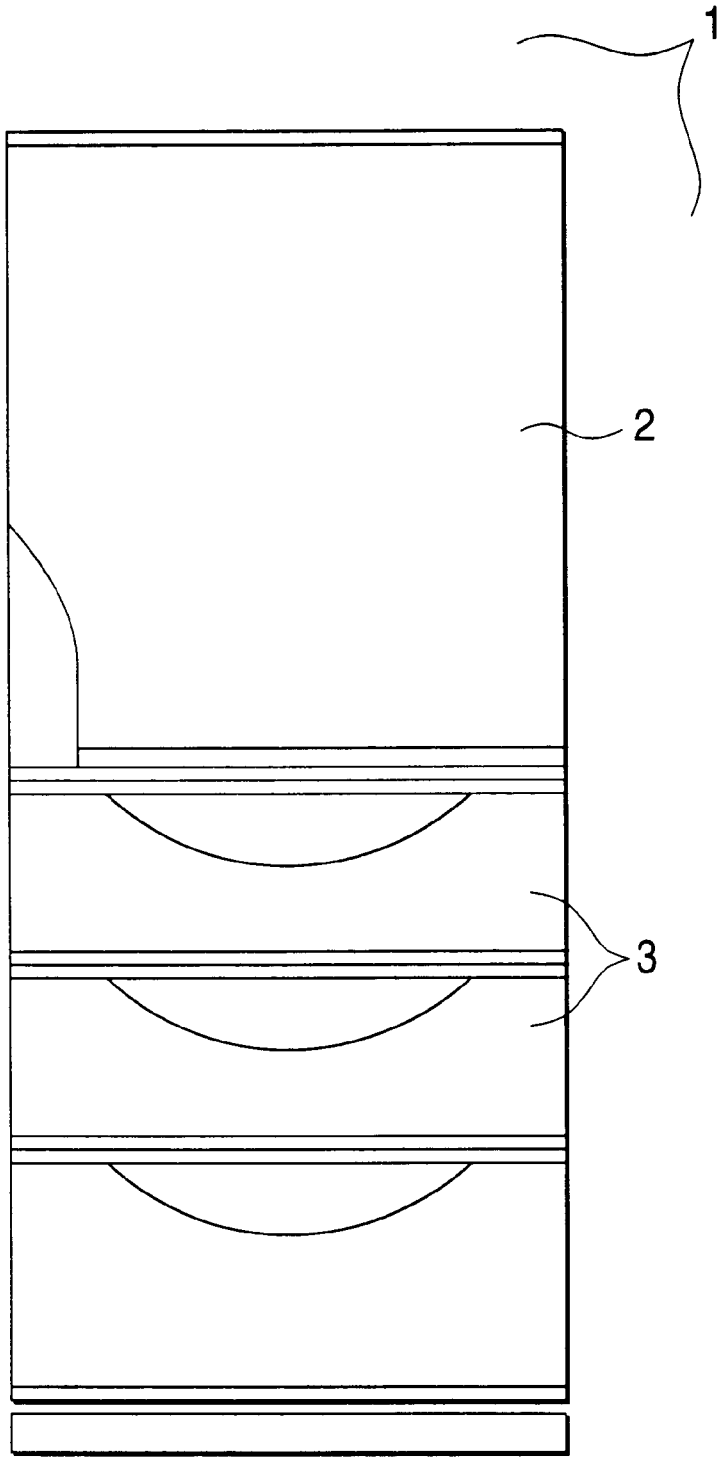
FIG. 13 PRIOR ART
FIG. 13 is an appearance view of the conventional freezer-equipped refrigerator.
Figure 14:
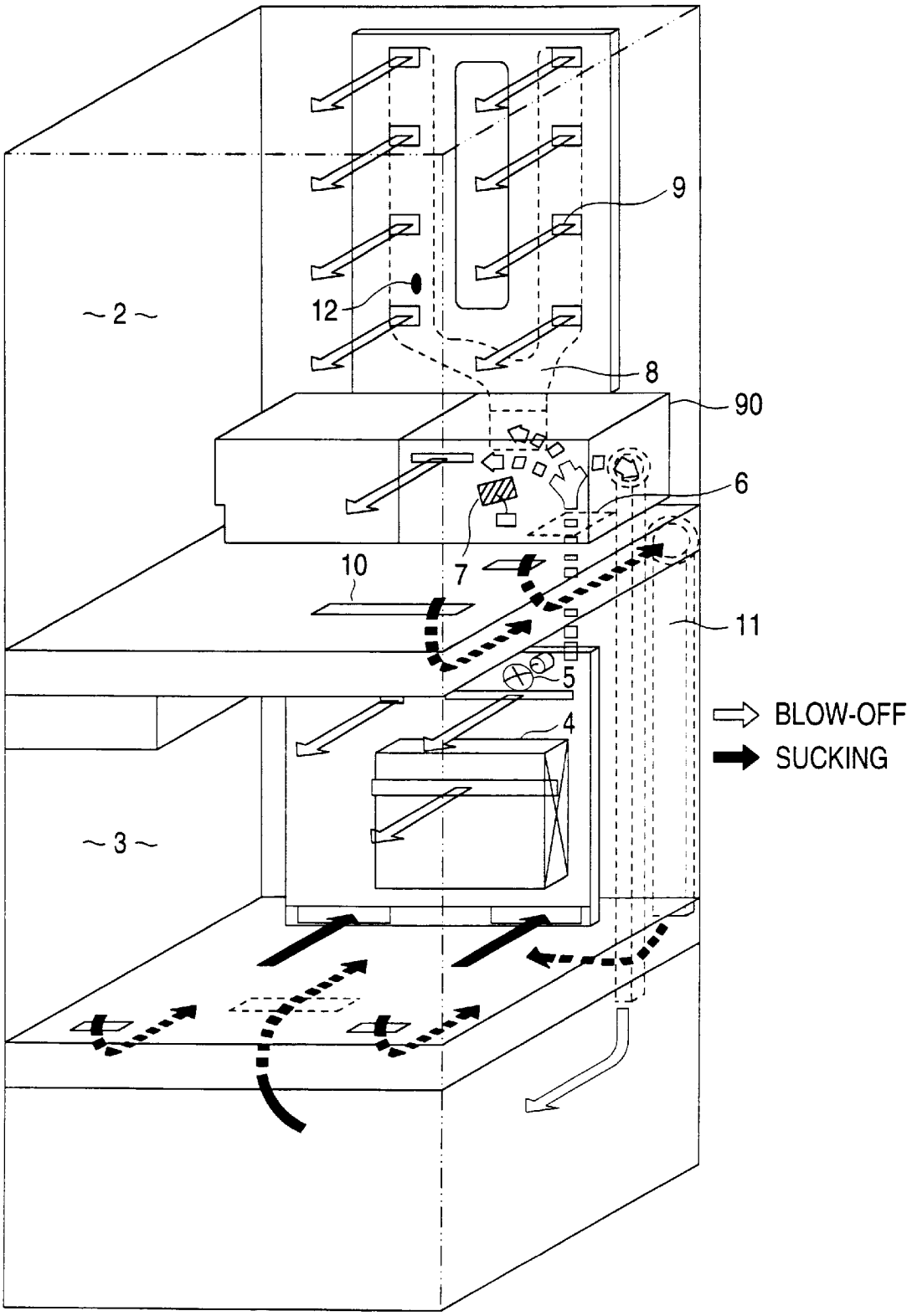
FIG. 14 PRIOR ART
FIG. 14 is a perspective view of a cool air passage structure of the conventional freezer-equipped refrigerator.
Figure 15:
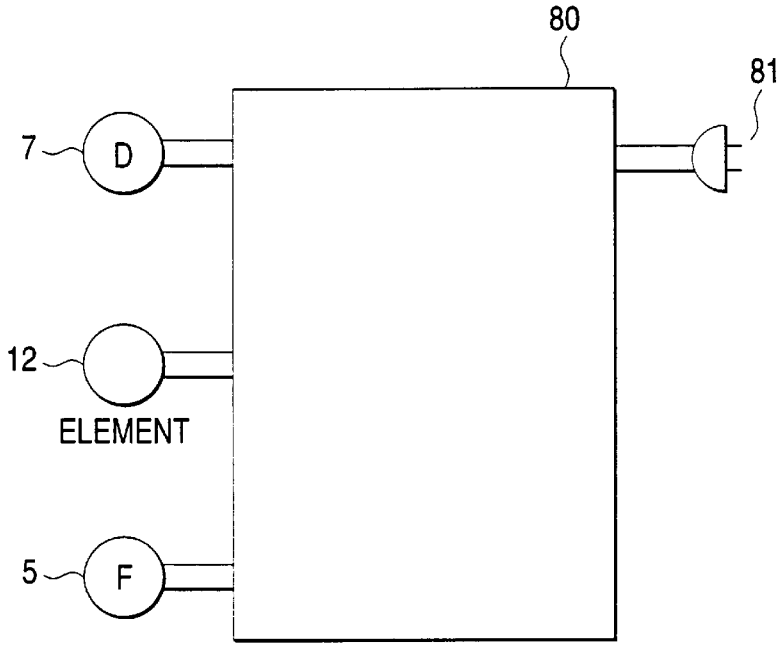
FIG. 15 PRIOR ART
FIG. 15 is a schematic view showing the control substrate 80 for controlling whether or not the circulation of cool air should be carried out in a conventional freezer-equipped refrigerator.
Figure 16:
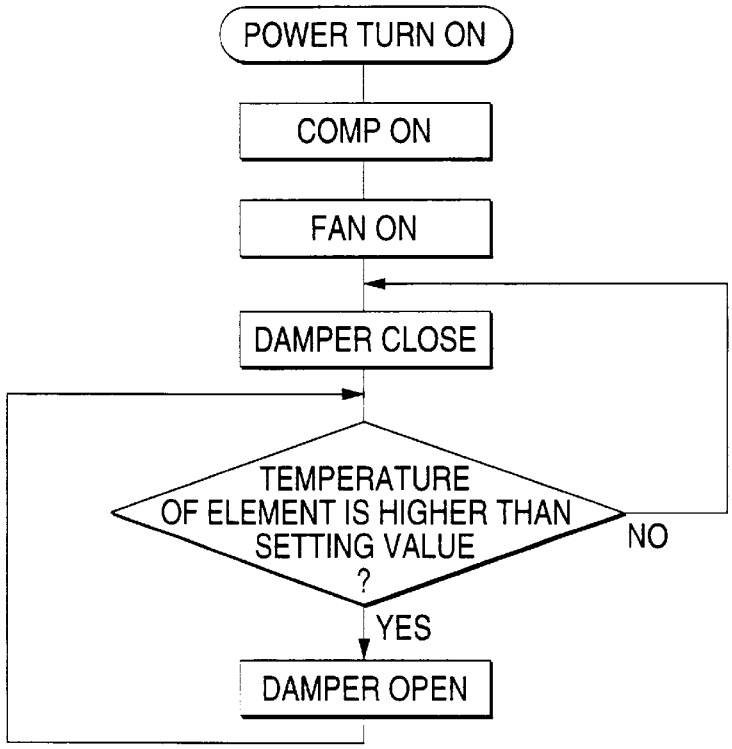
FIG. 16 PRIOR ART
FIG. 16 is a control flowchart for controlling whether or not the circulation of cool air should be carried out in a conventional freezer-equipped refrigerator.

Fifth embodiment is different from the second embodiment in the duct structure. FIG. 12 is a perspective view of the cool wind circulating wind passage in which the partition plate 50 at the back of the freezing chamber 2 as shown in FIG. 11A removed for convenience of illustration. Since cool wind supply ducts 30 and 31 are arranged on both sides on the back of the refrigerator, the refrigerator lamp 51 can be centrally installed at the back of the refrigerator 51. The cool air taken in from the cool air inlet 6 of a box 90 passes through the twin damper 20 and is blown off to the cool air blow-off opening 9 of each duct. One of the wind passages of the ducts 20 and 22 is the front in the box 90 whereas the other thereof is the rear (back) in the box 90. For example, if the inside lamp 51 is centrally located at the back of the refrigerator 2, a pair of ducts 30 for blow-off for both upper and lower sections and another pair of ducts 31 for blow-off for only the upper section are installed on both sides of the refrigerator. The ducts 30 separately blow up the cool air from the damper 20B towards both sides through this side (forward of the box 90) whereas the ducts 31 directly blow up the cool air toward both sides directly from the damper 20A. Inversely, the ducts 30 may blow up the cool air towards both sides directly from the damper 20B whereas the duct 31 may separately blow up the cool air toward both sides through this side (forward of the box 90) from the rear of the box 90. Because of such an arrangement of these wind passages, the cool wind can be supplied to the pair of ducts for both sections and only the upper section located on both sides of the inside lamp. The coupling manner of the above elements with the control substrate 80 and its operation are the same as in the second embodiment. Provision of the pair of ducts 30 and the pair of ducts 31 on both sides further improves the accuracy of making uniform the temperatures at the respective points obtained in the second embodiment. The limitation to the width of the refrigerator lamp due to the increase in the number of ducts and wind passages can be reduced, thereby improving the design.

In FIG. 12, a recess may be provided at the area on the center side of the refrigerator of the upper duct 21 where the cool wind blow-off opening 9 is not extended. This increases the illumination range of the inside lamp by the degree corresponding to the recess.

Although the structure of the refrigerating chamber has been described in the above-described embodiments, the structure also can be applied to that of the freezing chamber to control the temperature therein.

A freezer-equipped refrigerator according to the present invention has a plurality of sections at substantially equal setting temperature zones partitioned within the freezer-equipped refrigerator and comprises temperature detecting means provided in each of said sections; a plurality of cool air supply ducts each having a cool air blow-off opening for supplying the cool air to each of said sections, the number of them being equal to that of said temperature detecting means or sections; a damper for opening or closing a sucking inlet of the cool air into said cool air supply duct; and control means for controlling the open/close of said damper by the temperature detected by said temperature detecting means. Because of such a structure, the temperature of each section can be made uniform.

Since a damper portion having a plurality of dampers is provided, the number of components can be reduced.

A freezer-equipped refrigerator according to the present invention has a plurality of sections at substantially equal setting temperature zones partitioned within the freezer-equipped refrigerator, and comprises temperature detecting means provided in each of said sections; a plurality of cool air supply ducts each having a cool air blow-off opening for supplying the cool air to each of said sections, the number of them being equal to that of said temperature detecting means or sections; a damper connected to said plurality of ducts, for opening or closing a sucking inlet for supplying cool air to said cool air supply ducts; and control means for controlling the amount of the cool air from the sucking inlet to said plurality of cool air supply ducts by the opening angle of said damper opened or closed. Because of such a structure, a plurality of dampers are replaced by a single wind orientation adjusting damper and the refrigerator can be fabricated at low cost.

Since the amount of cool air to each of the cool air supply ducts is determined by open/close controlling the damper in accordance with the value of the temperature detecting means provided for each of the sections, the temperature of each section can be made uniform with accuracy thereby to maintain the freshness of food for a longer time.

Since said cool air supply ducts are a combination of a duct for supplying the cool air to a plurality of sections and another duct for supply the cool air to a specific section, even if "high burden" food at high temperatures are put locally or only within a certain section, the remaining sections are prevented from being cooled excessively.

The damper is open/close controlled using a difference between each of values detected by the temperature detecting means and each of setting temperatures, or using these values and the absolute value of a difference between the detected values. For this reason, the temperature difference between the respective sections can be minimized.

A plurality of cool air supply ducts are preferably arranged on both sides of the back of the inside of a refrigerator so that the cool air supply ducts are located on both sides of the inside of the refrigerator to supply the cool air through the same damper. For this reason, the temperature within the refrigerator can be made uniform.

Preferably, cool air is supplied through a first cool air supply passage extending upward from the back of the inside of the refrigerator to one of a plurality of cool air supply ducts arranged on the one side whereas it is supplied from a sucking inlet through a second cool air supply passage located in front of said first cool air supply passage to the other cool air supply duct. For this reason, the wind passages do not overlap so that the section of the inside of the refrigerator can be used effectively.

What is claimed is:

1. A freezer-equipped refrigerator comprising:

a refrigerating chamber;

a freezing chamber;

a plurality of sections formed within said refrigerating chamber, a setting temperature of said sections being substantially equal;

temperature detecting means provided in each of said sections, for detecting a temperature of each section;

a plurality of cool air supply ducts each having at least one cool air blow-off opening for supplying the cool air to each of said sections, the number of said cool air supply ducts being equal to the number of said temperature detecting means or said sections;

opening/closing means for opening/closing an inlet for sucking the cool air into said cool air supply ducts; and control means for controlling the open/close of all of said opening/closing means as a function of temperatures detected by said temperature detecting means.

2. A freezer-equipped refrigerator according to claim 1, wherein said opening/closing means is a dumper.

3. A freezer-equipped refrigerator according to claim 2, wherein said opening/closing means is a dumper portion having a plurality of dampers.

4. A freezer-equipped refrigerator according to claim 1, wherein said opening/closing means is connected to said plurality of cool air supply ducts, and said control means controls said opening/closing means to control the amount of the cool air from the sucking inlet to said plurality of cool air supply ducts.

5. A freezer-equipped refrigerator according to claim 4, wherein said opening/closing means is a dumper, and said control means controls said dumper to control the amount of the cool air by the opening angle of said damper.

6. A freezer-equipped refrigerator according to claim 1, wherein the amount of cool air supplied to each of the cool air supply ducts is determined by controlling said opening/closing means based on the temperature detected by said temperature detecting means provided in each of said sections.

7. A freezer-equipped refrigerator according to claim 1, wherein said cool air supply ducts include a first duct for supplying the cool air to a plurality of sections and a second duct for supplying the cool air to a specific section.

8. A freezer-equipped refrigerator according to claim 6, wherein said control means controls said opening/closing means based on a difference between a setting temperature and the temperature detected by said temperature detecting means.

9. A freezer-equipped refrigerator according to claim 6, wherein said control means controls said opening/closing means further based on an absolute value of a difference between the temperatures of said sections detected by said temperature detecting means.

10. A freezer-equipped refrigerator according to claim 6, wherein a plurality of cool air supply ducts are arranged on both sides of the back of the inside of the refrigerator so that the cool air supply ducts are located on both sides of the inside of the refrigerator to supply the cool air through the same damper.

11. A freezer-equipped refrigerator according to claim 6, wherein cool air is supplied through a first cool air supply passage extending upward from the back of the inside of the refrigerator to one of said plurality of cool air supply ducts arranged on the one side whereas cool air is supplied from a sucking opening through a second cool air supply passage located in front of said first cool air supply passage to the other cool air supply duct.

12. A freezer-equipped refrigerator as recited in claim 1, wherein said refrigerator is located above said freezer.

13. A freezer-equipped refrigerator comprising:

a refrigerating chamber;

a freezing chamber arranged vertically with respect to the refrigerating chamber;

a vertically arranged plurality of sections formed within said refrigerating chamber, a setting temperature of said sections being substantially equal;

a temperature detector provided in each of said sections, for detecting a temperature of each section;

a plurality of cool air supply ducts connecting said freezing chamber with said sections of said refrigerating chamber, each of said cool air supply ducts having at least one cool air blow-off opening for supplying the cool air to one of said sections, the number of said cool air supply ducts being equal to the number of said sections;

a damper individually associated with each of said cool air supply ducts so as to selectively open and close an inlet for sucking the cool air into the respective cool air supply duct; and control means for controlling the open/close of each of said dampers as a function of temperatures detected by said temperature detecting means.

* * * * *